United States Patent [19]

Bane

[11] Patent Number: 4,951,571

[45] Date of Patent: Aug. 28, 1990

[54] DRUM MINESWEEPER

[75] Inventor: Curtis G. Bane, Panama City, Fla.

[73] Assignee: The United States of America as represented by the Secretary of the Navy, Washington, D.C.

[21] Appl. No.: 550,887

[22] Filed: Feb. 13, 1975

[51] Int. Cl.[5] ..... F42B 22/42

[52] U.S. Cl. ..... 102/402; 89/1.13; 114/221 R

[58] Field of Search ..... 9/8 R; 114/0.5 F, 221 R; 102/18 MS, 13, 14; 340/5 D

[56] References Cited

U.S. PATENT DOCUMENTS

| | | | |
|---|---|---|---|
| 2,395,862 | 3/1946 | Freeman et al. | 116/27 |
| 2,447,069 | 8/1948 | Holcomb, Jr. | 367/3 |
| 3,720,908 | 3/1973 | McCoy et al. | 116/27 |
| 3,826,215 | 7/1974 | Dyjak | 114/221 R |

*Primary Examiner*—David H. Brown

*Attorney, Agent, or Firm*—Harvey David; John Becker; Sol Sheinbein

[57] ABSTRACT

A self-contained, freely floating, freely operating minesweeper is disclosed which facilitates the neutralization of marine mines in rivers, streams, and other water courses. Said minesweeper includes a barrel with a permanent magnet array mounted on the bottom thereof. An internal combustion engine, having a drive shaft and an exhaust output, in mounted within said barrel in such manner that the drive shaft extends through the side wall thereof. A partially fender shrouded paddle wheel is mounted on the end of said drive shaft for rotation therewith, and an exhaust pipe is connected to the exhaust output of said internal combustion engine, with the effluent end thereof located outside said barrel and radially therefrom in such manner as to cause the exhaust gases emanating therefrom to effect rotation thereof. A float collar is partially mounted around the outer periphery of the aforesaid barrel, so as to facilitate the attitude stabilization thereof.

12 Claims, 1 Drawing Sheet

DRUM MINESWEEPER

STATEMENT OF GOVERNMENT INTEREST

The invention described herein may be manufactured and used by or for the Government of the United States of America for governmental purposes without the payment of any royalties thereon or therefor.

FIELD OF THE INVENTION

The present invention, in general, relates to mine sweeping systems and, in particular, is a marine mine neutralizing device. In even greater particularity, the subject invention comprises an expendable and/or retrivable, unmanned, free-floating, mobile, marine mine destructor apparatus which when deployed in a river or stream is or may be propelled by the current thereof to such position in proximity with marine mines as to effect the detonation and neutralization thereof by means of a uniquely generated combination of acoustical and magnetic energy radiations, without unduely jeopardizing human minesweeping personnel.

DESCRIPTION OF THE PRIOR ART

Heretofore, the neutralization of marine mines was effected by such means as drag lines towed in contact with the mooring cables thereof, the deployment of explosive charges in proximity therewith, the towing of magnetic pipes and other magnetism generators and acoustic energy generators in the vicinity thereof, and the like. Although quite satisfactory for many practical purposes, in those situations where river mines are concerned, it has been determined that the use of towed or otherwise humanly operated minesweeping apparatus puts both the minesweeping apparatus and the personnel operating it in positions that make them vulnerable to ememy fire or other attack. Of course, such vulnerability and the hazards concomitant therewith occur as a result of the narrowness of a river or stream which, in turn, permits an enemy to covertly hide near the banks thereof and thereby launch his attack from a short but relatively safe distance from the openly expose minesweeping operations and the people involved therein.

SUMMARY OF THE INVENTION

The instant invention is a specialized marine mine detonating device. It overcomes some of the disadvantages of the prior art because it is relatively small and light weight, self-contained. easily transported, deployed, and operated, water current carried, unmanned, expandable and sometimes retrievable and usually safe to operate. Generally speaking, it comprises a floating drum which contain a plurality of permanent magnets mounted on the bottom thereof, a paddle wheel located on the side thereof, an internal combustion engine mount therein for powering said paddle wheel and for creating exhausted sonic and pressure energy signatures adjacent the outside thereof, the effects of which influence marine mines in such manner either magnetically or acoustically as to cause the detonation and, thus, the self-destruction thereof. A float collar is attached around the outside thereof in such manner as to hold the entire apparatus at a proper attitude when it is floating in water, and especially in river water having a current, thereby facilitating the maintenance of the optimum minesweeping disposition therefor.

It, therefore, is an object of this invention to provide an improved minesweeping device.

Another object of this invention is to provide a free-floating, self-contained, unmanned, marine mine neutralization system.

Still another object of this invention is to provide an improved method and means for detonating both magnetically and acoustically responsive marine mines deployed in rivers, streams, and other relatively narrow waterways.

A further object of this invention is to provide an improved method and means for effecting the detonation and destruction of marine mines in shallow water close to river banks, on shallow bars situated in wide water channels, and in river bends.

Another object of this invention is to provide a free-floating minesweeping device that may be transported to proposed operating areas by small support water craft, land craft, and aircraft.

Still anothe object of this invention is to provide an improved self-contained, floating and free-drifting, minesweeping apparatus that may be easily, swiftly, and more safely deployed from small boats, aircraft, and other carrier vehicles.

A further object of this invention is to provide a minesweeping apparatus that may be easily handled by combat military personnel.

Another object of this inventin is to provide a marine minesweeping device that is easily and economically manufactured, stored, maintained, transported, deployed, and, if necessary, expended.

Other objects and many of the attendant advantages will be readily appreciated as the subject invention becomes better understood by reference to the following detailed description, when considered in conjuction with the accompanying drawings.

DESCRIPTION OF THE PREFERRED EMBODIMENT

Figure 1:
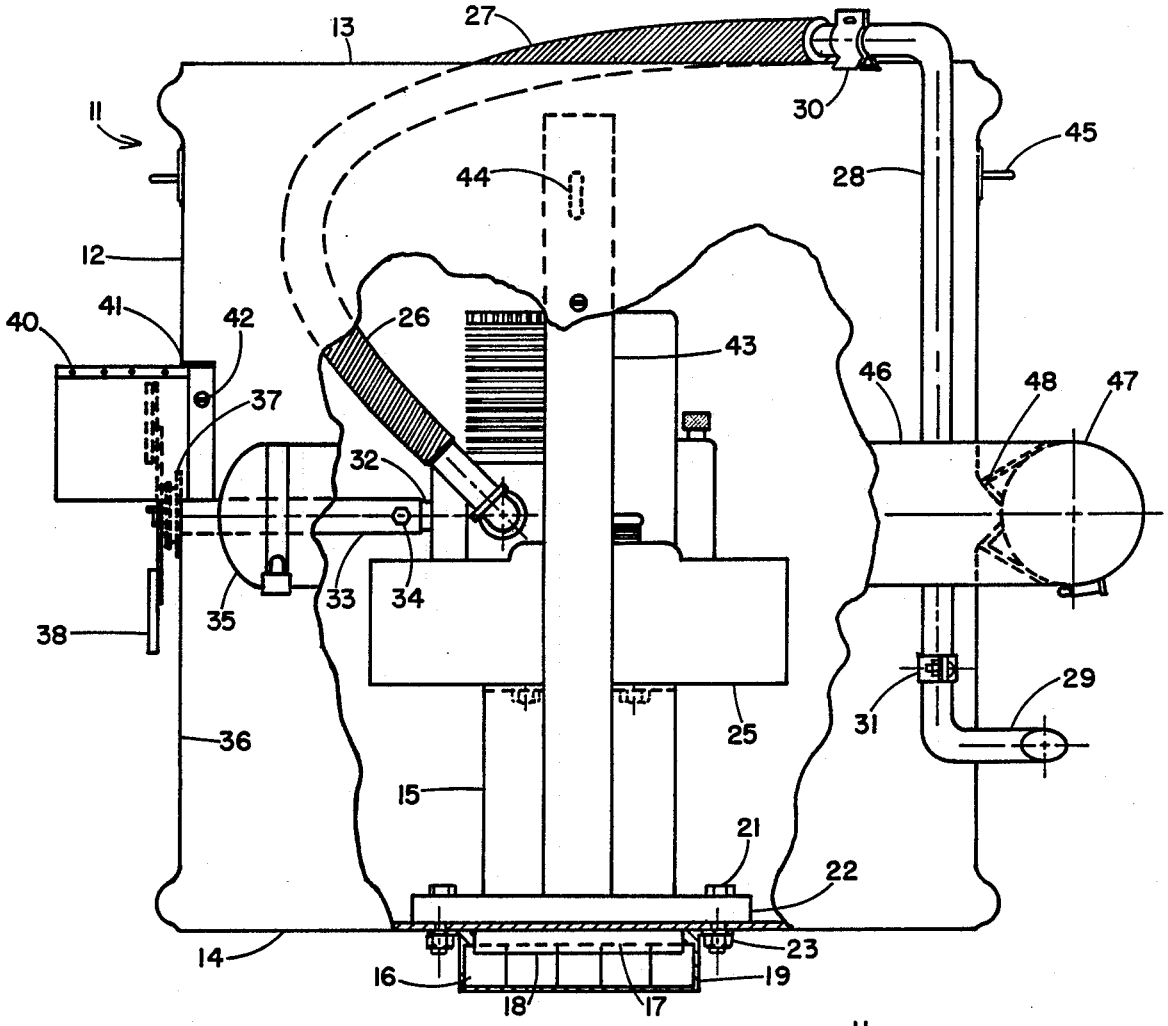
FIG. 1 is an elevational view, with parts broken away, of the minesweeping device constituting the invention.

Referring now to FIG. 1, the subject invention 11 is disclosed as having a cylindrical float, hull, or drum 12 that has an open and 13 at the tope and closed end 14 at the bottom.

At this time, it would appear to be noteworthy that although a cylindrical configuration is employed as the shape for float or hull 12 in the preferred embodiment presently being discussed, any suitable geometrical configuration may be used therefore. For example, it has been found that oil drums perform quite satisfactorily therefor, and, of course, they are usually readily available from commercial sources. Moreover, it should be understood that both ends of hull or oil drum 12 may be closed, in the event it becomes desirable that the entire minesweeper assembly be floatable at any attitude, or waterproof to protect the apparatus contained therein or to facilitate the deployment, storage, and operation thereof, or for any other appropriate reason required by circumstances.

Mounted inside of drum 12 is an unbalanced engine 15, preferably of the single cylinder, internal combustion type; however, any type which will properly fit within drum 12, produce reversing momentums, and a gaseous exhaust will suffice.

Also, effectively mounted on the underside of drum 12 is a plurality of permanent magnets 16 which are aligned in such manner as to provide optimum radiation of magnetism in downward radial directions therefrom. More specifically, a neoprene or other somewhat resilient, electrically insulative, plastic pad 17 is placed in abutment with the underside of the bottom of drum 12, a steel mounting plate 18, is placed next thereto, and a substantially cup-like box shaped mounting bracket 19 holds the entire magnet assembly together, as a result of its being effectively bolted to underwide wall 14 by means of a plurality of bolts 21 extending therethrough, through an engine connected engine mounting base plate or flange 22, and said lower drum wall 14. Of course, a plurality of nuts 23 tightened on bolts 21 respectively hold the entire assembly—including resilient pad 17—in such place as to provide leakproofing at the bottom 14 of drum 12, so as to prevent it from sinking when deployed in water.

The aforesaid engine 15 is conventional and, thus, contains a refillable gas tank 25, and an exhaust pipe 26 which, in this particular preferred embodiment, is a flexible hose 27 that extends out of the top of drum 12 and connects to a rigid pipe 28 which, in turn, is contiguously held along the outside of drum 12, but containing an off-set portion 29, by means of exhaust pipe brackets 30 and 31 welded and clamped thereto, resectively.

As may readily be seen, the lower end of rigid exhaust pipe 28 is curved in such way that the gas exhausting therefrom into the river water exerts a thrust on the drum, so as to make it turn about its longitudinal axis while it is floating therein, as will be discussed more fully subsequently.

Engine 15, of course, has a drive shaft 32 as the powered output therefrom. A shaft coupling 33 is connected thereto by any conventional means—such as, for example, by bolt 34—which extends through a hole 35 in side wall 36 of drum 12 and through any appropriate packing gland assembly 37 mounted on and connected to said wall 36—say, as by welding or the like—around said hole 35. Of course, packing gland 37 and coupling shaft 33 should be dimensionally compatible to the extent that the latter may be turned in the former without water leaking therebetween. A paddle wheel 38 is securely connected to the outer end of coupling shaft 33, the paddle blades 39 of which should be long enough to extend down into the water when drum 12 is floating therein.

A fender assembly 40 is connected, as by gasket 41 and bolts 42, to side wall 36 of housing drum 12 and is preferably configured in such manner that it overhangs and shields substantially the top half of paddle wheel 38, withot interfering with the rotation thereof.

A bracing arm 43, preferably having a U-shaped geometrical configuration, is connected to the aforesaid engine mounting base plate 22 and extends upwardly thereform in such manner that it can be used to lift engine 15 out of drum 12 more easily, if such is desired. Moreover, a pair of lifting eyes 44 are respectively connected to the U-extensions thereof to further facilitate the aforementioned engine removal from drum 12.

For the purpose of lifting the entire invention 12 out of the water and/or putting it back in, a plurality of handles 45 may optionally be installed around the outside surface of side wall 36 of drum 12, or at any other place or places required by operational circumstances. Obviously, it would be well within the purview of one skilled in the art having the benefit of the teachings presented herein to incorporate any other lifting eyes, handles, or the like which would facilitate the handling and operating of the subject invention in an optimum manner during any given operational cicumstances.

A syrafoam float collar 46 is disposed around the outside periphery of circular wall 36 of drum 12 at an intermediate position along the length thereof that substantially falls in the plane of aforementioned engine drive shaft 32. Said plane, of course, is normal to the longitudinal axis of float drum 12. Because paddle wheel 38 and fender 41 extend outwardly from wall 36 of drum 12, float collar 46 does not completely surround drum 12. Rather, there is a gap therein, so that there is no intereference with the turning of said paddle wheel 38 and still permit drum 12 to float at such level as to only put the lower half of said paddle wheel 38 in the water.

Float collar 46 may be attached to the outside surface of drum wall 36 by any suitable conventional means. In the particular preferred embodiment discussed herewith, a plurality of W-shaped float clamp brackets 47 ae employed, with the "W" points attached by welds 48 or otherwise secured to the outer drum surface. Of course, the size of the brackets used would be contingent upon the size of the float collar required, which, of course, is dependent upon the size and weight of the entire invention.

Figure 2:
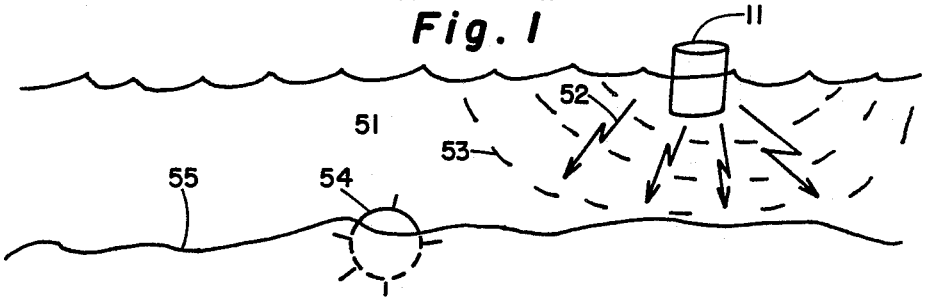
FIG. 2 is a pictorial elevational view of how the subject invention operates in mined waterways.

FIG. 2 discloses the invention in positin to be effective against both magnetically responsive marine mines and acoustically responsive marine mine. Hence, minesweeper 11 constituting this invention is depicted as freely floating in water 51, through which magnetic energy 52 and acoustical energy 53 is being broadcast toward a representative mine 54 that is resting on or perhaps buried or partially buried in the river bottom, sea floor, or the like 55.

Figure 3:
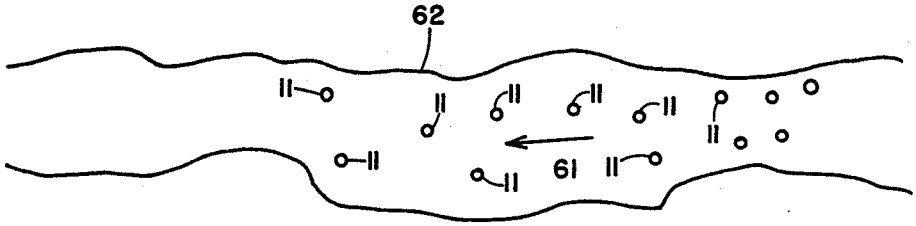
FIG. 3 is a pictorial view of how a plurality of the drum-type minesweeper devices constituting this invention freely travel along and, thus, effectively traverse a river or stream for marine minesweeping purposes.

FIG. 3 illustrates a typical manner in which a plurality of minesweepers 11 moves with river current, represented by arrow 61. Obviously, any number of the subject devices may be deployed to properly sweep and neutralize marine mines laid in the waterway 62 involved.

At this time, it may be worthy of note that the subject invention could possibly be used to neutralized land or other mines if a suitable means of placing them in proper proximity therewith were employed. This is true, because, when operative, it tends to braodcast some acoustical energy and magnetic energy to a considerable extent, regardless of where it is located at any given moment. Thus, for instance, the invention could be carried by the end of the boom of an overhanging mobile crane and thereby destructively influence acoustical and magnetically responsive mines of the marine, land, or other types, as long as it is positioned close enought thereto. Obviously, it would be well within the purview of the artisan having the benefit of the teachings presented herewith to use whatever vehicle would properly do the job of disposing the invention in proximity with the mines to be neutralized. Therefore, it should be understood that it is not intended that the instantly disclosed method and means of using and deploying the subject invention be limited thereto.

MODE OF OPERATION

Like the invention itself, the operation thereof is exceedingly simple, yet highly effective under certain circumstances. Therefore, this discussion of the opertion thereof will be very brief.

The invention may be placed in water, such as that shown as river 62 in FIG. 3, wherein floats, as is seen in FIG. 2. The placement thereof may be effected by human beings along a river bank, from boats or ships, form aircraft, or any other suitable carrier vehicle. Of course, they may also be automatically launched or otherwise deployed, if so desired, provided apparatus for doing so is available at the operational location. Furthermore, any number of the subject minesweepers may be deployed, as necessary.

However, just prior to deployment, engine 15 of each minesweeper 11 must be started, so as to insure that the exhaust gas is emanating therefrom and paddle 38 is turning. Of course, the exhaust gas, the running of engine 15, etc., all contribute to the broadcasting of acoustical energy 53 throughout the area immediate to the invention.

It is of considerable significance—since it improves the operation considerably—that the invention rotate in the water, as it is floating therein. Such rotation is effected by turning paddle wheel 38 and off-set 29 of exhaust pipe 28. Rotation thereof, of course, causes a more uniform distribution of both acoustical energy 53 and magnetic energy 52.

Because, the invention is free-floating, as best seen in FIG. 3, a plurality thereof will acquire various and sundry pattern configurations which, when used properly, effect the minesweeping of the entire river or of predetermined portions thereof.

Obviously, other embodiments and modifications of the subject invention will readily come to the mind of one skilled in the art having the benefit of the tachings presented in the foregoing description and the drawing. It is, therefore, to be understood that this invention is not to be limited thereto and that said modifications and embodiments are intended to be included within the scope of the appended claims.

What is claimed is:

1. A minesweeper for effecting the neutralization of acoustically and magnetically responsive mines located in a riverine environment, comprising in combination:

float means, having a vertical axis and a horizontal axis, capable of being floated in water with the vertical axis thereof substantially normal to the effective surface of said water;

means mounted on said float means for effecting the rotation thereof about said vertical axis while it is floating in said water;

means connected to said float means rotation effecting means for generating and broadcasting acoustical energy throughtout the water ambient to the bottom of said float means as it floats on said water; and means mounted on the bottom of said float means for broadcasting magnetic energy throughout the water ambient thereto when said float means is floating therein.

2. The device of claim 1, wherein said float means, having a vertical axis and a horizontal axis, capable of being floated in water with the vertical axis thereof substantially normal to the effective surface of said water comprises:

a cylindrical drum having a closed bottom end and an open top end.

3. The device of claim 1, wherein said float means, having a vertical axis and a horizontal axis, capable of being floated in water with the vertical axis thereof substantially normal to the effective surface of said water comprises:

a cylindrical drum having a closed bottom end and an open top end; and a float collar effectively connected around a portion of the periphery of said cylindrical drum in a plane that is substantially normal to the longitudinal axis thereof.

4. The device of claim 1, wherein said float means, having a vertical axis and a horizontal axis, capable of being floated in water with the vertical axis thereof substantially normal to the effective surface of said water comprises:

a hull; and a float collar effectively connected to a portion of the periphery of said hull in a plane that is substantially normal to the vertical axis thereof.

5. The device of claim 1, wherein said means mounted on the bottom of said float means for broadcasting magnetic energy throughout the water ambient thereto when said float means is floating therein comprises at least one permanent magnet.

6. The device of claim 1, wherein said means mounted on the bottom of said float means for broadcasting magnetic energy throughout the water ambient thereto when said float means is floating therein comprises:

an electrically insulative plastic pad disposed in abutment with the bottom of said float means;

a steel plate disposed in abutment with the bottom of said plastic pad;

a plurality of permanent magnets disposed in abutment with the bottom of said steel plate; and a bracket means urged upwardly against said plurality of permanent magnets and connected to the underside of said float means in such manner as hold said plastic pad, said steel plate, and said plurality of permanent magnets in predetermined substantially fixed positions relative to each other.

7. The device of claim 1, wherein said means connected to said float means rotation effecting means for generating and broadcasting acoustical energy throughout the water ambient to the bottom of said float means as it floats on said water comprises an exhaust pipe, the effluent end of which is submerged within said water and directed in such manner as to provided a propulsion assist to the aforesaid rotation effecting means.

8. The device of claim 1, wherein said means mounted on said float means for effecting the rotatin thereof about said vertical axis while it is floating in said water comprises:

an internal combustion engine having a rotatable drive shaft output;

a coupling shaft connected to said drive shaft output extending through the side wall of said float means;

a packing gland surrounding said coupling shaft and connected to the side wall of said float means in such manner as to effect a water tight seal therebetween while permitting said coupling shaft to rotate therein; and a paddle wheel mounted on the outer extremity of said coupling shaft for rotation therewith.

9. The invention of claim 9, further characterized by a fender mounted on the outside surface of the wall of said float means in such manner as to cover the upper half of said paddle wheel, while leaving the lower half thereof exposed to the environment ambient thereto.

10. A minesweeper means for effecting the neutralization of acoustically and magnetically responsive mines, comprising in combination:

a drum having at least a closed end at the bottom thereof;

at least one permanent magnet mounted on the bottom of the closed end of said drum;

an engine, having a rotatable drive shaft and an exhaust gas output, mounted inside said drum, with the drive shaft thereof effectively extending through the side wall of said drum in such manner as to permit rotation thereof while providing a fluid tight seal threat;

an exhaust pipe connected to the exhaust gas output of said engine, with the outer effluent extremity thereof extending to the outside of said drum and in proximity with the side and bottom thereof;

a paddle wheel connected to the outer extremity of said drive shaft;

a fender connected to the outside of the side wall of said drum in such manner as to cover substantially one-half of the aforesaid paddle wheel; and means connected to said drum for effecting a predetermined disposition thereof while said drum is being moved in neutralization-influence proximity with the aforesaid acoustically and magnetically responsive mines.

11. The device of claim 11, wherein said engine is an internal combustion engine.

12. The device of claim 11, wherein said means connected to said drum for effecting a predetermined disposition thereof while said drum is being moved in neutralization-influence proximity with the aforesaid acoustically and magnetically responsive mines comprises a flotation collar.

* * * * *